US009194217B2

(12) United States Patent
Watson et al.

(10) Patent No.: US 9,194,217 B2
(45) Date of Patent: Nov. 24, 2015

(54) METHOD AND SYSTEM OF SAND MANAGEMENT

(75) Inventors: Graham Watson, Sugar Land, TX (US); Dinesh Patel, Sugar Land, TX (US); Tom Saunders, Sugar Land, TX (US); Luis Felipe Peixoto, Kalimantan Timur (ID); Ricardo Gomez Simancas, Jakarta (ID); Julien Debard, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 873 days.

(21) Appl. No.: 12/787,435

(22) Filed: May 26, 2010

(65) Prior Publication Data

US 2010/0300687 A1 Dec. 2, 2010

Related U.S. Application Data

(60) Provisional application No. 61/181,526, filed on May 27, 2009.

(51) Int. Cl.

| | |
|---|---|
| ***E21B 43/14*** | (2006.01) |
| ***E21B 43/04*** | (2006.01) |
| ***E21B 34/06*** | (2006.01) |

(52) U.S. Cl.

CPC ..... *E21B 43/04* (2013.01); *E21B 34/06* (2013.01); *E21B 43/14* (2013.01)

(58) Field of Classification Search

CPC ..... E21B 43/14; E21B 43/04

USPC ..... 166/51, 278, 276

See application file for complete search history.

(56) References Cited

U.S. PATENT DOCUMENTS

| | | | | |
|---|---|---|---|---|
| 5,579,844 | A * | 12/1996 | Rebardi et al. | 166/296 |
| 5,832,996 | A * | 11/1998 | Carmody et al. | 166/53 |
| 6,189,619 | B1 * | 2/2001 | Wyatt et al. | 166/332.1 |
| 6,446,729 | B1 * | 9/2002 | Bixenman et al. | 166/386 |
| 6,464,006 | B2 | 10/2002 | Womble | |
| 7,665,535 | B2 * | 2/2010 | Van Wulfften Palthe | 166/385 |
| 8,127,847 | B2 * | 3/2012 | Richard et al. | 166/295 |
| 2002/0148610 | A1 * | 10/2002 | Bussear et al. | 166/278 |
| 2003/0075326 | A1 | 4/2003 | Ebinger | |
| 2006/0124304 | A1 | 6/2006 | Bloess | |
| 2008/0149351 | A1 * | 6/2008 | Marya et al. | 166/387 |
| 2008/0164027 | A1 * | 7/2008 | Sanchez | 166/278 |
| 2009/0008092 | A1 | 1/2009 | Haeberle | |
| 2010/0012318 | A1 * | 1/2010 | Luce et al. | 166/278 |
| 2012/0080188 | A1 * | 4/2012 | Richard et al. | 166/278 |

* cited by examiner

*Primary Examiner* — Blake Michener
*Assistant Examiner* — Kipp Wallace
(74) *Attorney, Agent, or Firm* — Patrick Traister; Brandon Clark

(57) ABSTRACT

A technique facilitates sand control in a wellbore. A lower completion and an upper completion are run downhole into the wellbore and deployed. The lower completion assembly employs a plurality of packers to isolate well zones. The lower completion assembly also has gravel pack ports which are independently opened to enable gravel packing of each individual zone via a tool run downhole. Additionally, the lower completion assembly has a production port in each zone. A shifting tool is employed to open the production ports and to enable production from the well zones.

11 Claims, 5 Drawing Sheets

METHOD AND SYSTEM OF SAND MANAGEMENT

CROSS-REFERENCE TO RELATED APPLICATION

The present document is based on and claims priority to U.S. Provisional Application Ser. No. 61/181,526, filed May 27, 2009.

BACKGROUND

In many well applications, various completions and completion techniques are employed to limit the influx of sand from the surrounding formation. Many types of completions have been designed to inhibit or block the migration of sand into downhole equipment in an effort to avoid damage to the equipment which can otherwise result as particulate matter passes through with the production fluid. A variety of sand screens and/or gravel packs may be employed to control the sand production. However, current equipment and techniques can be relatively complex, burdensome and expensive to employ.

SUMMARY

In general, the present invention provides a technique for providing sand control in a wellbore. A lower completion is run downhole into the wellbore engaged with, or subsequently engaged with, an upper completion. The lower completion assembly employs a plurality of packers to isolate well zones. Gravel pack ports are independently opened to enable gravel packing of each individual zone via a coil tubing string or other small diameter tubing string run downhole. Subsequently, a separate shifting tool is employed to open production ports which enable production from the isolated well zones.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a method and system for controlling sand in a well application. According to one embodiment, the method and system enable a simplified approach to providing a completion assembly in a wellbore with protection against the influx of sand from the surrounding formation. The technique enables deployment of a lower completion assembly and also an upper completion string. In many applications, the lower completion assembly and the upper completion string are deployed downhole together in a single trip for a one trip installation. However, the technique may be adapted to deploy the lower completion assembly in a first run in hole and the upper completion string in a subsequent run.

The present technique enables the wellbore to be segregated into a plurality of well zones which facilitate production of fluid from a plurality of corresponding well zones in the surrounding formation. Each of the well zones along the wellbore may be individually gravel packed to help limit the flow of sand into the lower completion assembly. The technique provides a simple approach to gravel packing independent zones and subsequently opening the zones to production of a desired well fluid. Additionally, the technique provides the ability to employ a non-service tool, non-sealbore gravel packing system.

Figure 1:
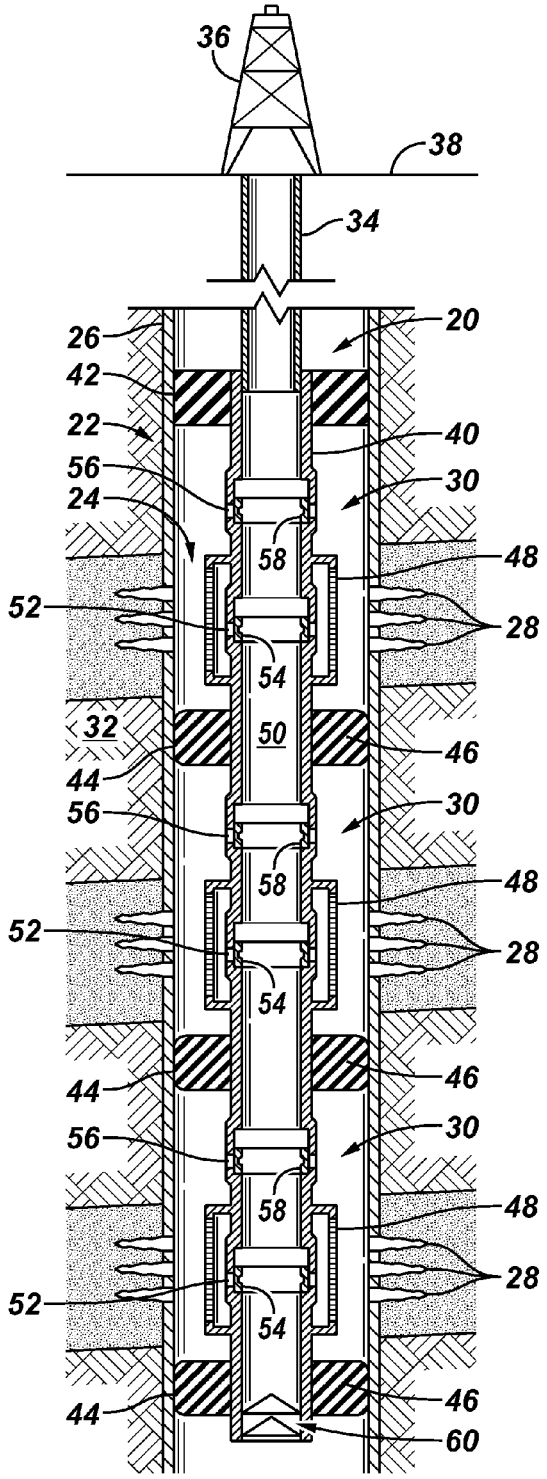
FIG. 1 is an illustration of a sand control system employed in a wellbore, according to an embodiment of the present invention.

Referring generally to FIG. 1, an embodiment of a sand control system comprises a lower completion assembly 20 which is illustrated as deployed in a well 22. The well 22 is defined by a wellbore 24 which, in this example, has been lined with a liner or casing 26. A plurality of perforations 28 has been formed through the casing 26 in each of a plurality of well zones 30. The perforations 28 enable flow of a production fluid, e.g. a hydrocarbon based fluid, from a surrounding formation 32 into the wellbore 24.

The lower completion assembly 20 is run in hole to a desired location within wellbore 24 to enable retrieval of the production fluid from the desired reservoir within formation 32. A conveyance 34 is employed to convey the lower completion assembly 20 to the desired location within wellbore 24. Depending on the environment and application, conveyance 34 may comprise a variety of tubing types, cables, or other suitable conveyances. In the embodiment illustrated, a rig 36 is positioned at a surface location 38 to deploy lower completion assembly 20 downhole via conveyance 34. It should be noted the present technique enables deployment of the lower completion assembly 20 and an upper completion assembly (described below) in a single trip to facilitate an efficient, one trip installation. Thus, in many applications the lower and upper completions are deployed together, and description of the lower completion assembly herein does not imply a two trip installation technique. However, certain environments and/or types of completion equipment may be amenable to a two trip installation.

In the embodiment illustrated in FIG. 1, the lower completion assembly 20 comprises a completion tubular 40 to which an upper packer 42 is mounted. By way of example, the upper packer 42 may comprise a Quantum packer available from Schlumberger Corporation. Additionally, a plurality of isolation packers 44 is positioned along the tubular 40 to enable isolation of the well zones 30 along wellbore 24. The isolation packers 44 may comprise a variety of devices able to seal off the annulus between tubular 40 and the surrounding casing 26. According to one embodiment, however, isolation packers 44 are constructed as swellable packers formed with a swellable material 46 which swells in the presence of a specific substance. For example, the swellable material 46 may be designed to swell and expand against the surrounding wellbore wall when exposed to a specific fluid, e.g. diesel fluid, or another fluid designed to cause swelling and expansion of the material 46. In some applications, however, packers 44 may comprise mechanical packers.

The lower completion assembly 20 also may comprise a plurality of screens 48, such as manifold screens, designed to further prevent movement of undesired particulate matter into an interior 50 of completion tubular 40. Radially inward from each screen 48, the lower completion assembly 20 further comprises one or more production ports 52 which may be selectively opened and closed via a corresponding production sliding sleeve 54, or other suitable flow control device. The sliding sleeves 54 enable selective control over the inflow of production fluid through the corresponding screen 48 and into interior 50 of lower completion assembly 20.

In the embodiment illustrated, the lower completion assembly 20 further comprises a plurality of gravel pack ports 56 with at least one gravel pack port 56 extending through completion tubular 40 in each well zone 30. The gravel pack port or ports 56 of each well zone 30 may be positioned above the production ports 52 and screen 48 within that well zone 30. Flow through the gravel pack ports 56 is controlled by corresponding gravel pack sliding sleeves 58, or other suitable flow control devices, to control the outflow of slurry into the surrounding annular region.

Depending on the specific application, lower completion assembly 20 may further comprise a valve mechanism 60 positioned in interior 50 of tubular 40 at a lower end of lower completion assembly 20. The valve mechanism 60 may be employed to control flow along interior 50 by, for example, restricting flow past lower completion assembly 20 to a single flow direction. By way of example, valve mechanism 60 may comprise a double poppet shoe or a check valve.

Figure 2:
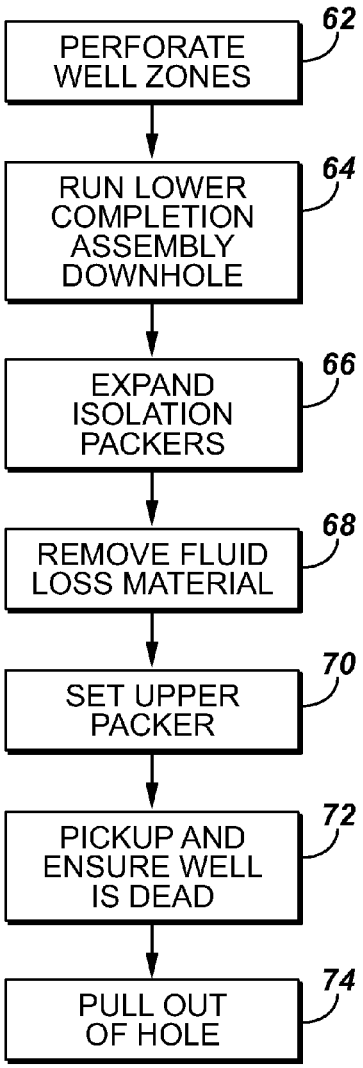
FIG. 2 is a flowchart illustrating an example of a sand control procedure, according to an embodiment of the present invention.

With additional reference to the flow chart of FIG. 2, one example of an initial sand control procedure utilizing lower completion assembly 20 is illustrated. In this example, a perforating procedure is initially carried out to perforate each well zone 30 with perforations 28, as represented by block 62. Subsequently, the lower completion assembly 20 is run downhole into wellbore 24 via rig 36, as represented by block 64. Once the lower completion assembly is positioned at the desired setting depth within wellbore 24, the isolation packers 44 are expanded against the surrounding wellbore wall, as represented by block 66. According to at least one embodiment, expansion of the isolation packers 44 is achieved by displacing an activating fluid through a service tool to expand the isolation packers by swelling the swellable material 46. The activating fluid flowed downhole also may be used to remove fluid loss material, e.g. fluid loss pills, deployed over the perforations 28, as represented by block 68.

The upper packer 42 may then be set, as represented by block 70. By way of example, upper packer 42 may be set by dropping a setting ball down through conveyance 34; however other mechanisms also may be used to set the upper packer 42 against the surrounding wellbore wall. Subsequently, the rig 36 is employed to pickup the service tool and to reverse the activating fluid flow, if activating fluid has been deployed downhole. At this stage, the operator also ensures that the well is dead by, for example, inflow testing if necessary, as represented by block 72. The conveyance 34 and service tool, if deployed, are then pulled out of hole, as represented by block 74.

Figure 3:
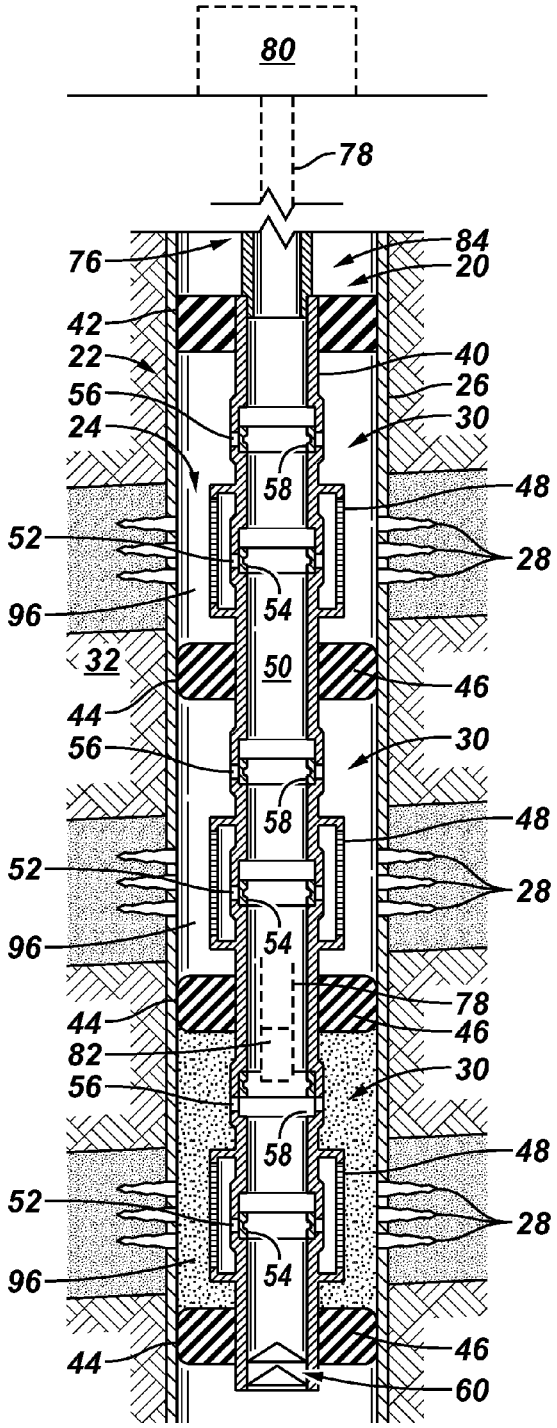
FIG. 3 is an illustration of the sand control system during another stage of operation, according to an embodiment of the present invention.

Referring generally to FIG. 3, an upper completion string 76 is illustrated as deployed downhole into engagement with lower completion assembly 20. As described above, the upper completion 76 and the lower completion 20 often are joined before run in and then run in hole in a single trip. The upper completion string 76 may be engaged within the upper end of lower completion assembly 20 via a variety of available engagement mechanisms and techniques. Once the upper completion string 76 and lower completion assembly 20 are positioned in the wellbore, coil tubing 78 may be deployed downhole through upper completion string 76 into lower completion assembly 20 via surface based coil tubing equipment 80. The coil tubing 78 can be used to manipulate a variety of coil tubing tools 82 within lower completion assembly 20. It should be noted that upper completion string 76 is combined with lower completion assembly 20 to form an overall sand control system 84. In some applications, coil tubing string 78 may be replaced by a small diameter, through-tubing jointed pipe. Additionally, the coil tubing equipment 80 may comprise a coiled tubing barge which allows the completion deployment rig 36 to be moved off location. In many applications, movement of the rig 36 off the wellbore to enable use of the coil tubing barge or other coil tubing equipment 80 substantially increases operational efficiency and provides great financial benefit with respect to the gravel packing operation.

Figure 4:
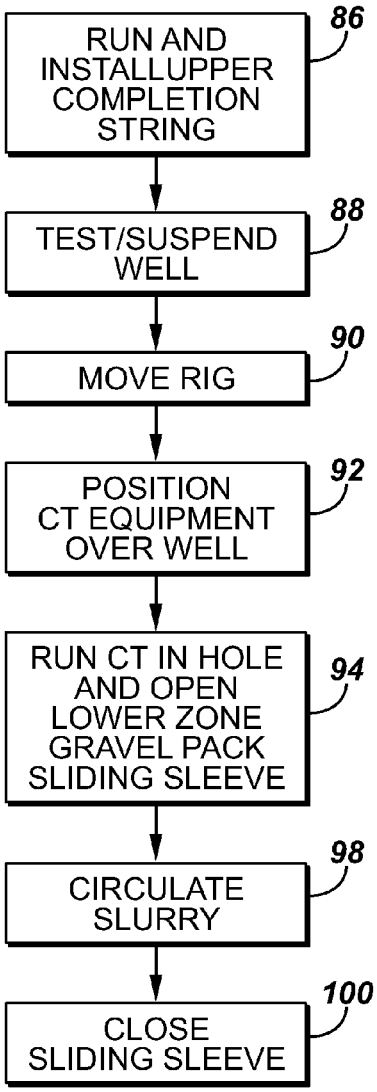
FIG. 4 is a flowchart illustrating an example of another sand control procedure, according to an embodiment of the present invention.

With additional reference to the flow chart of FIG. 4, an example of a subsequent sand control procedure utilizing lower completion assembly 20 is illustrated. In this example, the upper completion string 76 is run and installed downhole, as represented by block 86. The well is then tested and suspended, as represented by block 88. This allows the rig 36 to be moved off location, as represented by block 90. During movement of the rig off location, swell packers 44 may be allowed to activate, i.e. swell. (In other applications, however, the packers 44, e.g. mechanical packers, are set prior to leaving location with the main rig 36.) Subsequently, coil tubing equipment 80 is moved over well 22 and positioned for deploying coil tubing 78 downhole, as represented by block 92.

Once the coil tubing equipment 80 is in place, coil tubing 78 is run in hole and coil tubing tool 82 is used to move the gravel pack sliding sleeve 58 and to open the corresponding gravel pack port 56 of the lowermost well zone 30 instead of using an internal service tool, as represented by block 94. Slurry is then directed downhole through the coil tubing 78, out through coil tubing tool 82, and then through the lowermost gravel pack port 56. The slurry is circulated through an annular region 96 surrounding the lower completion assembly 20 in the lowermost well zone 30 (see FIG. 3), as represented by block 98. In this embodiment, the slurry may then be squeezed, as opposed to circulated, across the lowermost perforations 28. Subsequently, the lowermost gravel pack sliding sleeve 58 is closed via coil tubing tool 82, as represented by block 100.

Figure 5:
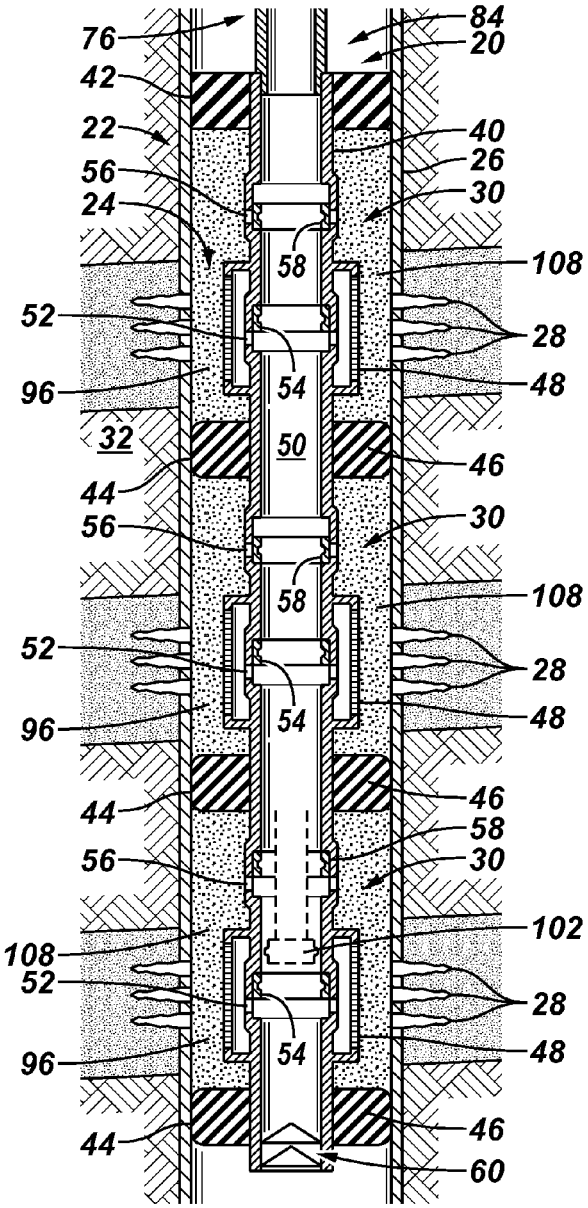
FIG. 5 is an illustration of the sand control system during another stage of operation, according to an embodiment of the present invention.
Figure 6:
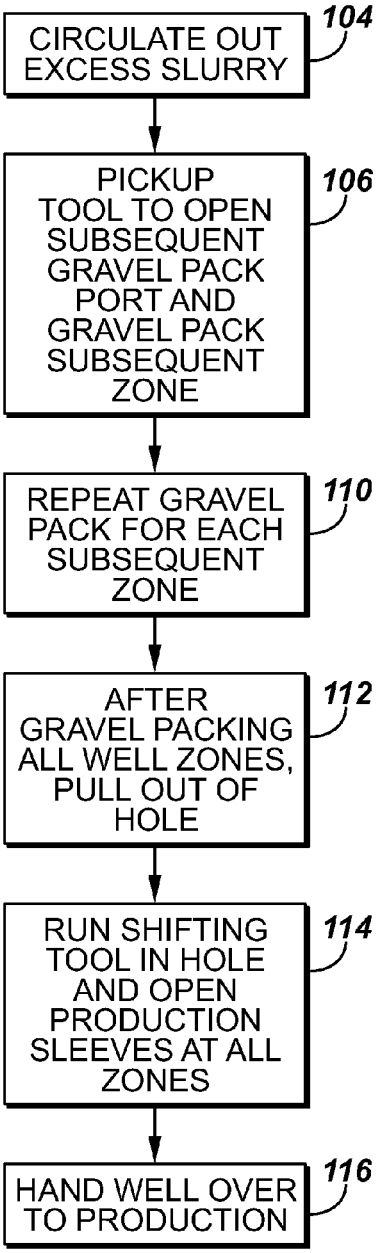
FIG. 6 is a flowchart illustrating an example of another sand control procedure, according to an embodiment of the present invention.

Referring to FIGS. 5 and 6, a subsequent procedure of the overall sand control technique is illustrated. As illustrated in FIG. 5, a shifting tool 102 may be employed within lower completion assembly 20 to facilitate preparation of the well 22 for production. Referring to the flowchart of FIG. 6, however, one example of a procedural approach for finalizing preparation of the well 22 for production is illustrated.

Following gravel packing of the lowermost well zone 30, excess slurry is circulated out, as represented by block 104.

The coiled tubing tool 82 is then picked up to open the next sequential gravel pack port 56 by moving its corresponding gravel pack sliding sleeve 58. This allows the subsequent well zone 30 to be gravel packed by squeezing slurry across the well zone perforations, as represented by block 106. The gravel packing procedure is repeated for each subsequent well zone 30 until each annular region 96 is filled with an appropriate gravel pack 108, as represented by block 110.

Once the gravel packing procedure is completed at each well zone 30 and a gravel pack 108 is disposed in each annular region 96, the coil tubing tool 82 is pulled out of hole, as represented by block 112. After removing coil tubing tool 82, the shifting tool 102 is run in hole on, for example, coil tubing 78 deployed by coil tubing equipment 80. The shifting tool 102 is used to open all of the production ports 52 by moving the corresponding production port sliding sleeves 54, as represented by block 114. After opening the production ports 52 to enable the inflow of production fluid, e.g. oil, the well 22 is ready for production, as represented by block 116. Within each well zone 30, the gravel pack 108 and screen 48 cooperate to provide sand control by restricting the influx of sand into interior 50 of lower completion assembly 20. The design of lower completion assembly 20 provides an easy and effective system and procedure for controlling the influx of sand.

Figure 7:
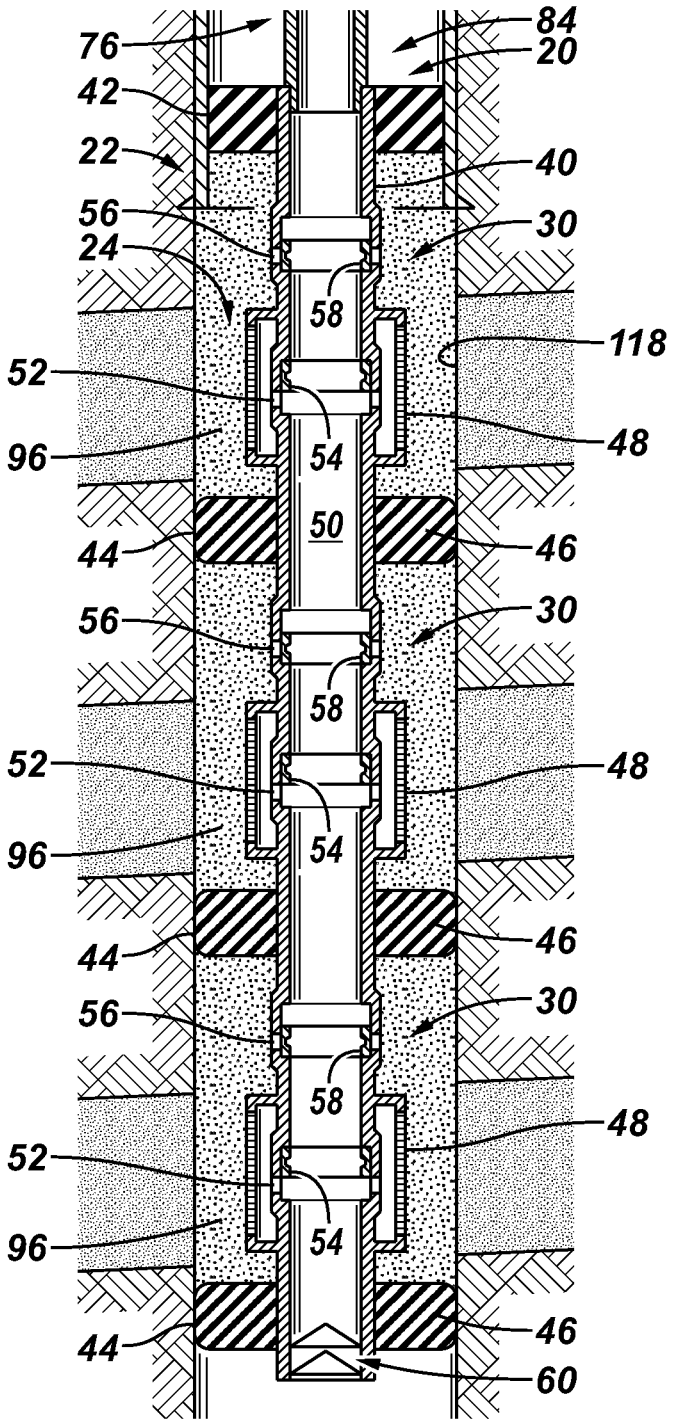
FIG. 7 is an illustration of an alternate example of a sand control system, according to an embodiment of the present invention.

Referring generally to FIG. 7, another example of the overall sand control system 84 is illustrated. In this embodiment, the lower completion assembly 20 and upper completion 76 are deployed in an open hole wellbore. The isolation packers 44 are then expanded against a surrounding open wellbore wall 118 rather than against a surrounding wellbore wall formed of casing 26. In this example, the isolation packers 44 also may be formed as swellable isolation packers, although other types of expandable packers, e.g. mechanical packers, may be used to seal off regions of wellbore 24 within the open wellbore wall 118. In this embodiment, the same types of procedures as described above with reference to FIGS. 1-6 may be employed to gravel pack each annular region 96 and to prepare the well for production. With respect to at least some open hole applications, an additional shroud may be placed around each gravel pack port 56 to avoid slurry dehydration back into the wellbore.

Figure 8:
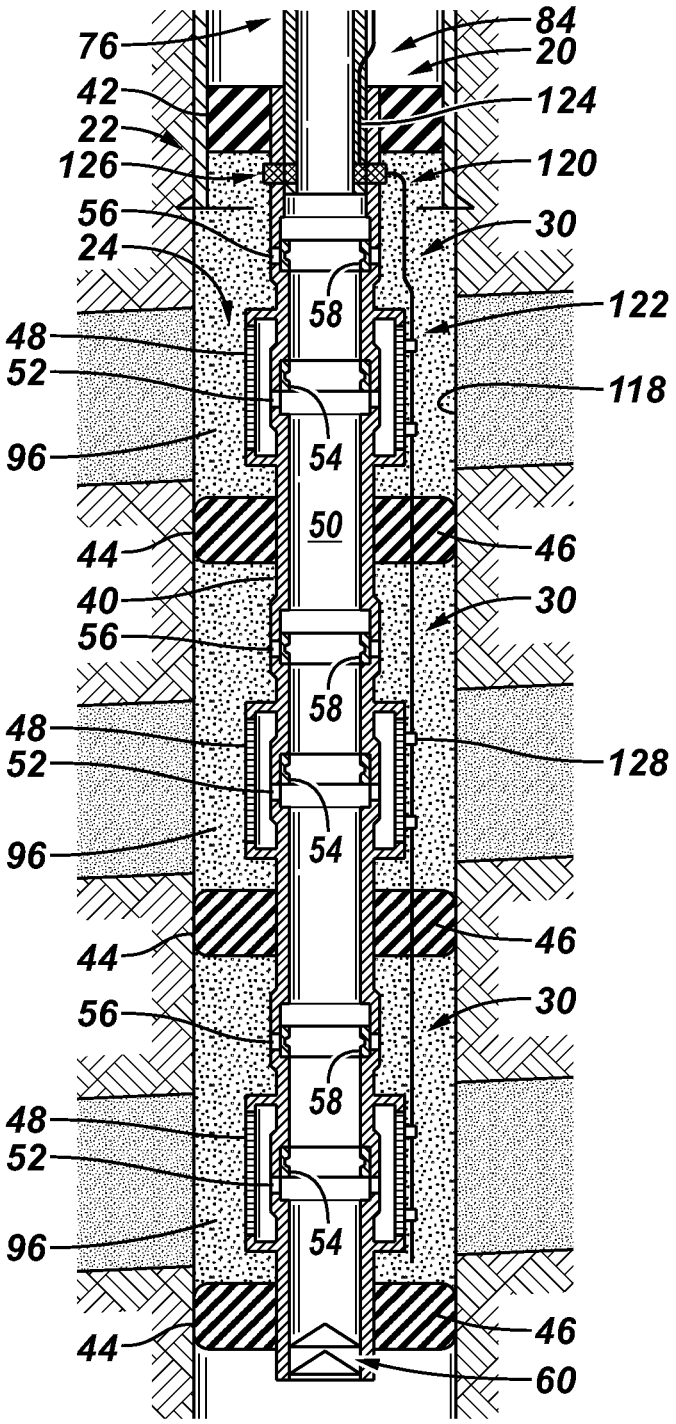
FIG. 8 is an illustration of another alternate example of a sand control system, according to an embodiment of the present invention.

In another embodiment, the overall sand control system 84 is designed with sandface monitoring capabilities. As illustrated in the embodiment of FIG. 8, a sandface monitoring system 120 may be deployed along lower completion assembly 20. Although sandface monitoring system 120 may comprise a variety of sensors and other components, one example utilizes a sensor system 122 deployed along an exterior of completion tubular 40. The sensor system 122 is coupled with a communication line 124 via an appropriate coupler mechanism 126. In this example, communication line 124 is routed up along upper completion string 76 to a surface location. The coupler mechanism 126 is adapted according to the specific sensor system employed, however one example comprises an electro-inductive coupler.

In the example illustrated, sensor system 122 may comprise a suitable sensor 128, such as a fiber optic sensor or sensor gauges. Regardless, the sensor or sensors 128 may be used to monitor desired parameters across the sandface, such as temperature, pressure and flow. Depending on the specific design of sensor system 122, the sandface monitoring system 120 may be run in one trip for ease of installation; or sections of the sandface monitoring system 120 may be joined downhole. When a fiber-optic sensor is employed, the optical fiber may be pumped down through a corresponding tube to avoid the need for a coupler mechanism 126. However, a substantial variety of deployment techniques may be used to accommodate a wide range of sensors, coupler mechanisms, and other potential components of the sandface monitoring system 120.

The system and technique described above demonstrate a simple approach to sand control in a well. However, a variety of adaptations and adjustments may be made to accommodate a variety of well environments. For example, the lower completion assembly 20 may be run in hole with coil tubing, jointed pipe, or other suitable conveyance techniques. Additionally, the lower completion assembly 20 and upper completion 76 may be run in hole in a single trip. The sandface monitoring system 120 also may be run in hole with the lower completion assembly 20 or with the combined lower completion assembly 20 and upper completion 76.

Furthermore, the upper packer 42 may comprise a hydraulically set open hole packer or a cased hole packer set by a dropped ball or other mechanism. The well zones 30 may be gravel packed and/or frac-packed. Additionally, the lower completion assembly 20 enables selective production from individual well zones 30 and also selective injection to individual well zones 30. With the overall simplified system, no seal bores are required to enable the gravel packing or frac-packing procedures described above. In some applications, a live annulus is possible to enable real-time monitoring of downhole treatment pressure without friction effects otherwise resulting from surface pumping through tubing/coil tubing. The overall sand control system 84 also is suitable for rigless well treatments with coil tubing and/or treatments employing a rig and jointed pipe.

When valve mechanism 60 is employed, a check valve or double poppet washdown shoe allows displacement of underbalance packer swelling fluids while still enabling well control. If well zones 30 are to be treated with a consolidated treatment for sand control, the screens 48 may be replaced with sliding sleeves. In this type of application, the top sliding sleeve may be opened and used to consolidate; and then the top sliding sleeve is closed so the lower sleeves can be used for production or injection as required. Additionally, a variety of activating fluids may be pumped down to swell the isolation packers 44 and/or break down the fluid loss pills/material placed across the perforations 28 following the perforating portion of the overall sand control procedure. Depending on the parameters of a given application, various portions of the procedure discussed above may be interchanged or eliminated. For example, the upper completion may be run before or after the gravel pack treatment is completed.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method of preparing a sand control system, comprising:

a) running a lower completion and an upper completion downhole into a wellbore in a single trip via a rig;

b) expanding a plurality of packers, of the lower completion, against the surrounding wellbore wall to create a plurality of well zones;

c) moving the rig off the wellbore;

d) after moving the rig, positioning coil tubing equipment over the wellbore;

e) after moving the rig, deploying coil tubing with a coil tubing tool through the wellbore to open a gravel pack sliding sleeve, of the lower completion, within a well zone;

f) squeezing slurry into the well zone;

g) closing the gravel pack sliding sleeve with the coil tubing tool by moving the coil tubing;

h) circulating out excess slurry;

i) picking up the coil tubing tool and opening a next sequential gravel pack sliding sleeve;

j) repeating elements e, f, g and h for each additional well zone of the plurality of well zones;

k) maintaining the coil tubing in the wellbore while gravel packing the well zones;

l) after repeating elements e, f, g and h for all well zones, pulling the coil tubing and the coiled tubing tool out of the wellbore; and m) subsequently opening all production sleeves of the lower completion with a shifting tool run on coil tubing.

2. The method as recited in claim 1, wherein expanding comprises swelling a plurality of isolation packers.

3. The method as recited in claim 1, further comprising perforating all well zones of the plurality of well zones prior to running the lower completion downhole.

4. The method as recited in claim 3, further comprising removing fluid loss material from the perforations.

5. The method as recited in claim 1, wherein expanding comprises expanding mechanical packers.

6. The method as recited in claim 1, wherein opening comprises opening all production sleeves with a coil tubing shifting tool.

7. The method as recited in claim 1, wherein deploying comprises using a surface coil tubing barge.

8. The method as recited in claim 1, wherein opening comprises opening all production sleeves with the shifting tool run in hole in a separate run.

9. The method as recited in claim 1, wherein running comprises running the lower completion into a cased wellbore.

10. The method as recited in claim 1, wherein running comprises running the lower completion into an open wellbore.

11. The method as recited in claim 1, further comprising employing a sandface monitoring system with the lower completion.

* * * * *